United States Patent [19]

Lindqvist

[11] 3,964,777

[45] June 22, 1976

[54] REMOTE-CONTROLLED LOADING HOOK

[75] Inventor: Jonas Herman Lindqvist, Hudiksvall, Sweden

[73] Assignee: Hiab-Foco Aktiebolag, Hudiksvall, Sweden

[22] Filed: Mar. 7, 1975

[21] Appl. No.: 556,341

[30] Foreign Application Priority Data

Mar. 7, 1974 Sweden ..... 7403025

[52] U.S. Cl. ..... 294/83 R

[51] Int. Cl.[2] ..... B66C 1/34

[58] Field of Search ..... 294/66 R, 82 R, 83 R, 294/83 A, 83 AB, 84, 110 R; 24/230.5 PA, 24/230.5 AC, 230.5 SS, 230.5 SA, 232, 241 R, 24/241 P, 242

[56] References Cited

UNITED STATES PATENTS

| | | | |
|---|---|---|---|
| 1,449,364 | 3/1923 | McGowan | 24/242 |
| 1,467,885 | 9/1923 | Stahl | 294/83 R |
| 2,666,664 | 1/1954 | Johnson | 294/83 R |
| 2,771,316 | 11/1956 | Mitchell | 294/83 R |
| 2,864,644 | 12/1958 | Marryatt | 294/83 R |
| 3,056,624 | 10/1962 | Nardone | 294/83 R |
| 3,311,401 | 3/1967 | Bacon | 294/83 R |
| 3,625,558 | 12/1971 | Johnson | 294/83 R |

*Primary Examiner*—Evon C. Blunk
*Assistant Examiner*—Johnny D. Cherry
*Attorney, Agent, or Firm*—Newton, Hopkins & Ormsby

[57] ABSTRACT

A remote-controlled loading hook is provided with a hook-shaped means having its upper end journalled on a pin in the upper portion of a casing. The hook-shaped means is adapted to be swung with its lower end, shaped as a hook, into the casing. The casing is freely suspended in a cable, a chain or the like. The casing has an opening in its lower part and the carrying hook, which has a locking abutment, is adapted to bridge said opening. A seat is arranged on either side of the opening to support the carrying hook in position of use. The hook-shaped means is suspended on the pin in such a way that at the lifting of the casing and the loading of the hook-shaped means the latter can move in vertical direction relative to the casing to a position in which one of the seats catches behind the locking abutment of the hook.

8 Claims, 4 Drawing Figures

REMOTE-CONTROLLED LOADING HOOK

BACKGROUND OF THE INVENTION

When a crane having vertically movable loading hooks of conventional construction is used for loading and unloading of goods, the crane operator must be given assistance to bring the hook into and out of engagement with lifting eyes or straps on the goods. Such an assistance is cost consuming. Further, it is time-wasting for a person to move between the loading and unloading places and also the risk of personal damages is considerable.

SUMMARY OF THE INVENTION

The object of the invention is to overcome these drawbacks. The main characteristic of the invention is to be seen therein that the loading hook comprises a hook-shaped member being with its upper end journalled about a pin at the upper part of a casing, said hook-shaped means adapted when the casing is hanging freely in a cable, a chain or the like to be swung by a drive means with its lower end, this end shaped as a carrying hook and provided with a catch, into the casing and to bridge an opening in the lower part of the casing. Said lower part of the casing is on either side of the opening provided with a seat for the carrying hook in the position of use of the same. The hook-shaped means is suspended on the pin in such a way that at the inclination of the casing and the loading of the carrying hook the hook-shaped means can in vertical direction relative to the casing move to a position in which one of said seats engages behind the catch on the hook. This device gives the crane operator a possibility from his operation seat comfortably to open and to close the loading hook by means of different types of remote control devices. Thus, there is no longer any need of assistance from an associate. When the load is suspended in the hook, there is no risk whatsoever that the hook could be opened unintentionally as the hook-shaped means is locked in position of use. The risk of accidents is as a consequence reduced to an absolute minimum.

BRIEF DESCRIPTION OF THE DRAWINGS

The invention will now be elucidated with reference to the accompanying, partly diagrammatical drawings. In the drawings.

DETAILED DESCRIPTION OF THE DRAWINGS

Figure 1:
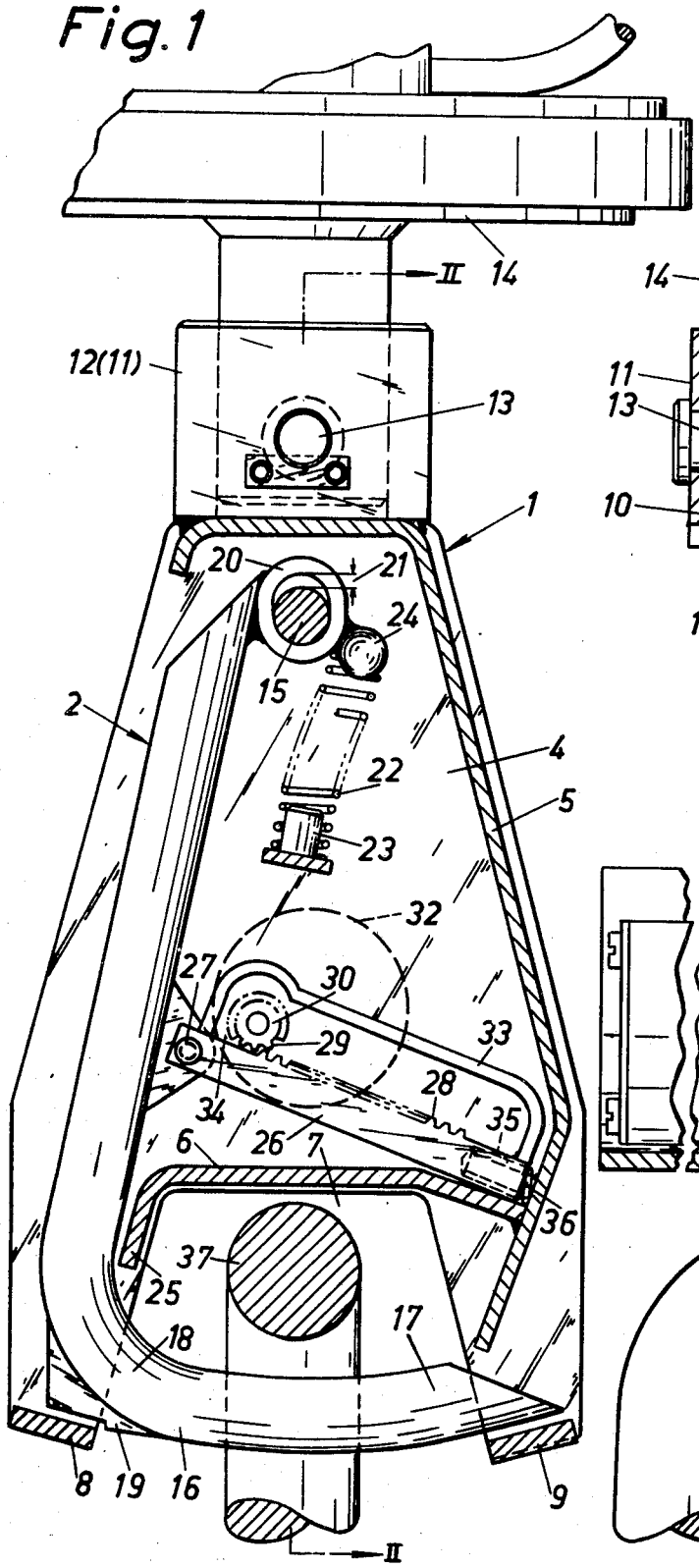
FIG. 1 shows a vertical section of loading hook according to the invention with its hook-shaped means swung into the interior of the casing.
Figure 2:
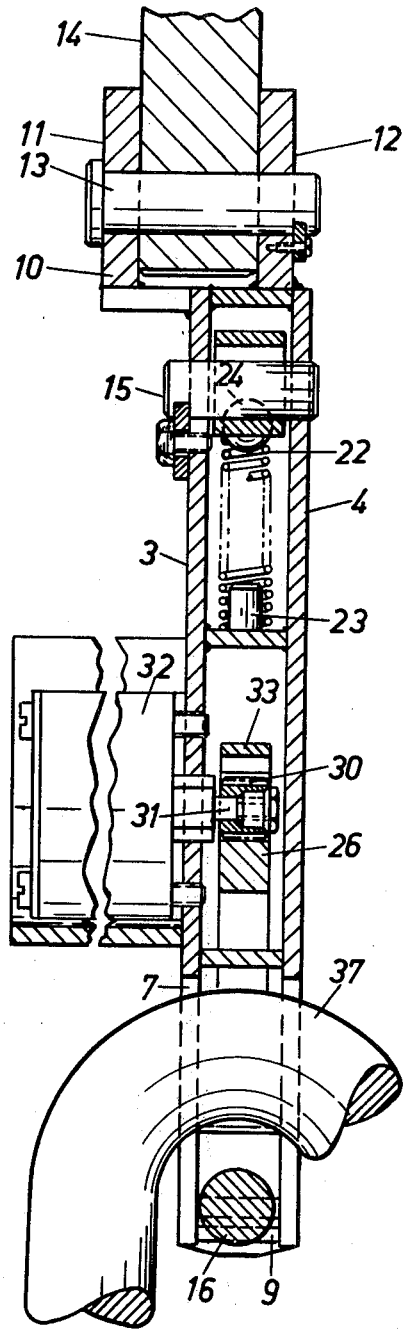
FIG. 2 shows a vertical section on the line II-II in FIG. 1.

The two main portions of the loading hook comprise a casing 1 and a hook-shaped means 2. The casing 1 comprises two parallel side walls 3 and 4 which are interconnected by means of a gable piece 5 and an intermediate piece, a partition 6. At its lower end the casing is provided with an opening 7 and on either side thereof with seats 8, 9. At its upper end the casing 1 is shaped as a fork 10, the legs 11, 12 of which are passed through by a shaft 13 which is carried by the lower end of a rotator 14.

A pin 15 is arranged at the upper portion of the casing 1 and the hook-shaped means 2 is, by means of its upper end, journalled on said pin 15. The lower end of the means 2 is shaped as a carrying hook 16 having such a length that it, when the hook-shaped member 2 is swung into the casing 1, will have its front portion 17 situated above the seat 9 and its rear portion 18 situated above the seat 8. The rear portion 18 is provided with a locking abutment 19. The upper end of the hook-shaped means 2 is shaped to provide an oval hub 20 having such a play 21 between the pin 15 and the inner bearing surface of the hub that the hook-shaped means 2 is allowed to perform a restricted vertical movement. The helical spring 22 which is inserted between a pin 23 in the interior of the casing and a ball-shaped arm 24 on the hub 20, retains the hook-shaped means 2, when unloaded, in its upper position (FIG. 1). The spring 22 also tends to swing the hook-shaped means 2 into the interior of the casing 1 in the direction towards an abutment 25 on the partition 6.

The hook-shaped member 2 is also provided with a ratchet 26 extending into the casing 1 and being with one end journalled about a pin 27 on the hook-shaped means. The teeth 28 on the ratchet 26 cooperate with the teeth 29 on a cogged wheel 30 on the shaft 31 of a reversible electric motor 32 arranged on the outer surface of the wall 3 of the casing 1. Extending above the ratchet 26 is a guiding bow 33 which at its ends is connected to the ratchet 26 at the two ends of the latter. The row of teeth 28 does not extend quite as far as to the ends of the ratchet 26 but a pair of idling positions 34, 35 of the wheel 30 are arranged at said ends. The outer end of the ratchet 26 is provided with a helical spring 36 which, when the hook means 2 is swung completely into the casing 1, is clamped between the ratchet 26 and the gable piece 5.

Figure 3:
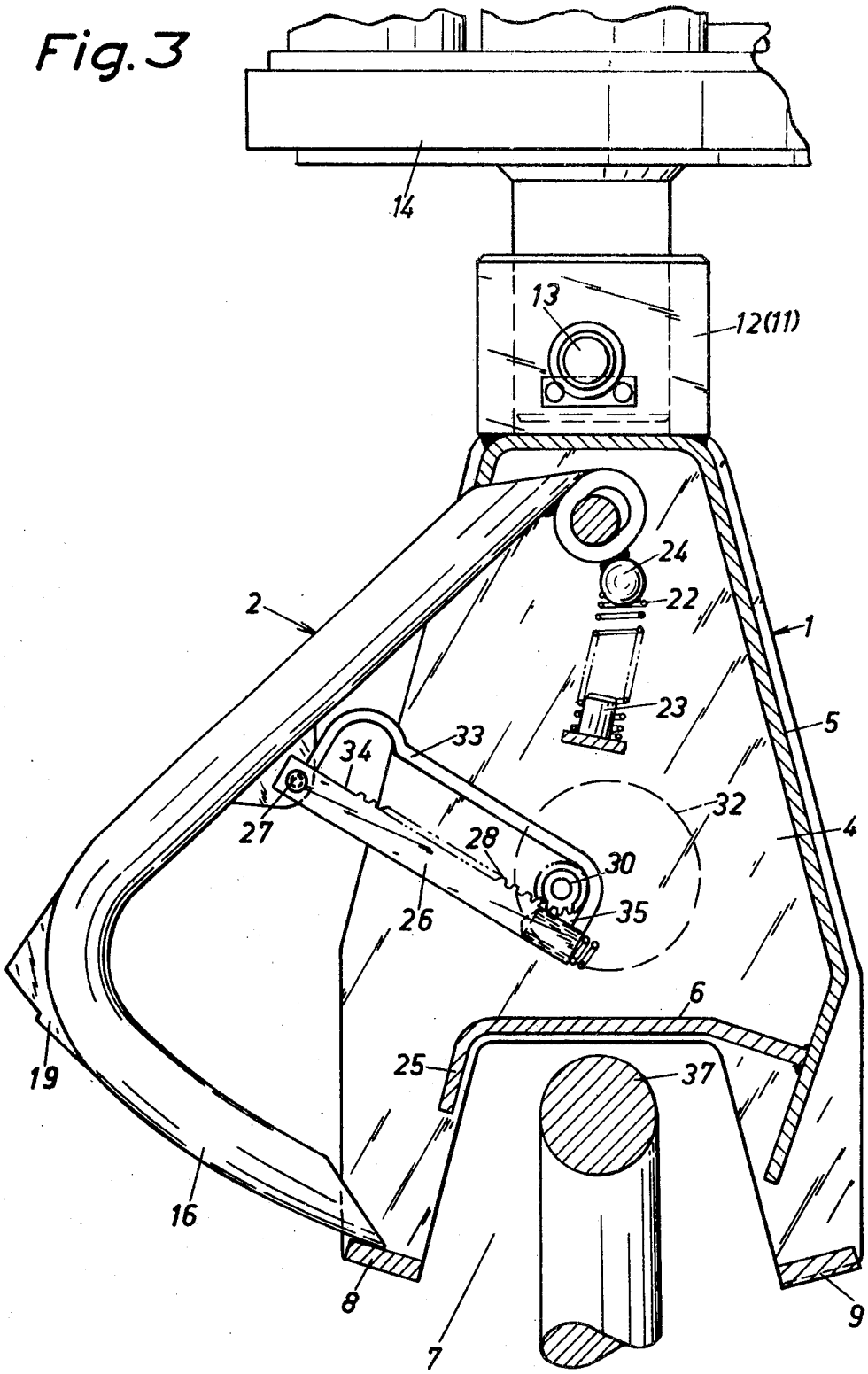
FIG. 3 shows a section as in FIG. 1 but with the hook-shaped means swung to an outer position.
Figure 4:
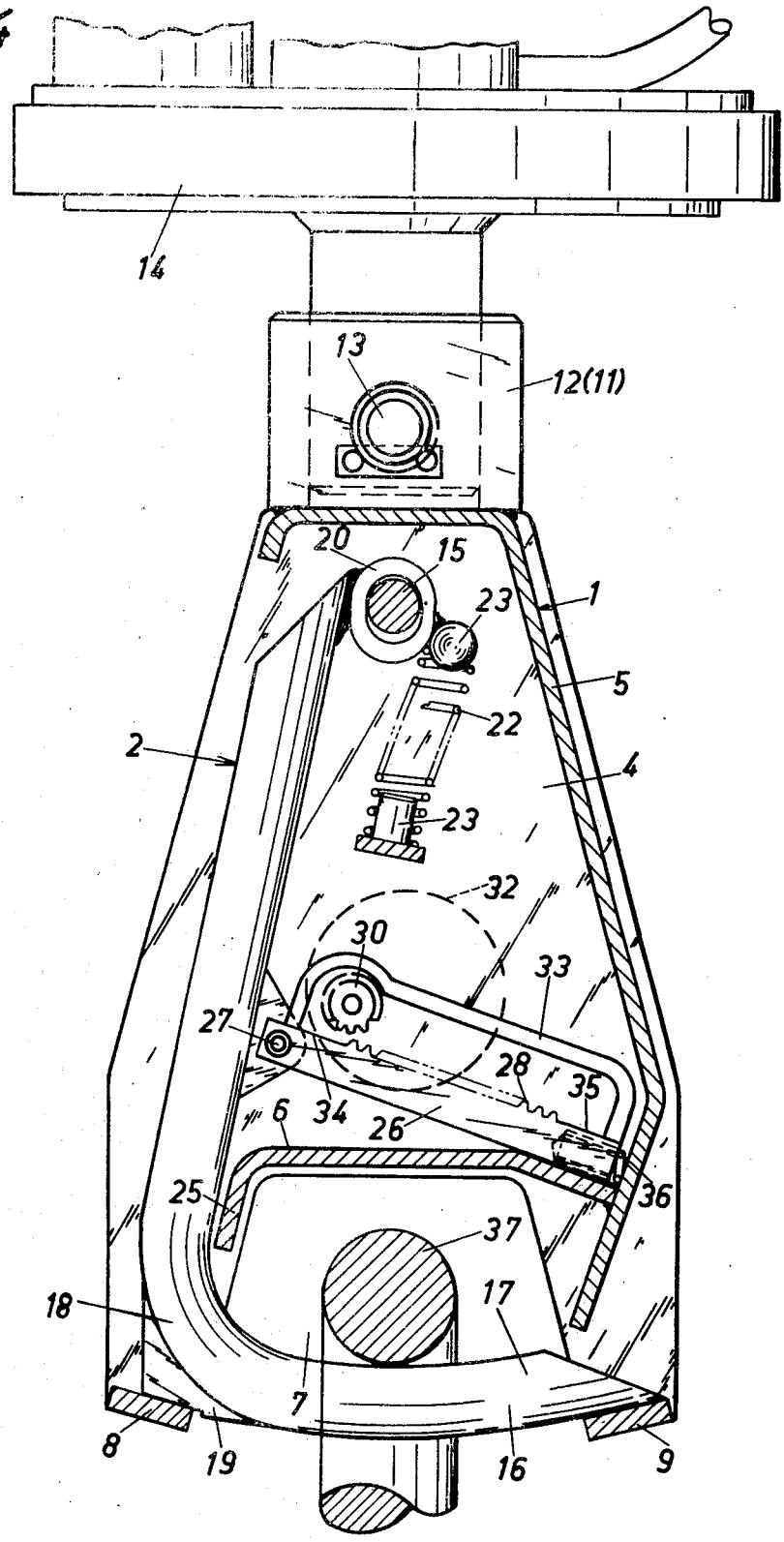
FIG. 4 shows a section similar to the one of FIG. 1 but disclosing the hook-shaped means locked in position of use during the lifting of a load.

When the carrying hook 16 is unloaded (FIG. 1), the spring 36 presses the ratchet 26 with its tooth situated closest to the pivot shaft 27 against the cogged wheel 30 which, when the motor 32 is started in clockwise direction, engages the ratchet 26 and moves the latter together with the hook-shaped means 2 outwards (to the left according to FIG. 1) till the outer idling position 35 reaches the cogged wheel 30. The loading hook is then as a whole swung with the crane (not shown) and is turned by means of the rotator 14 and lowered in such a way that a loading eye 37 on the goods (not shown) to be lifted will be situated in the opening 7 of the lower portion of the casing 1. The hook-shaped means 2 was swung outwards against the action of the spring 22 which means that the ratchet 26 with its tooth situated closest to the idling position 35 will press against the cogged wheel 30. When the motor 32 is restarted, this time, however, in counter-clockwise direction according to FIG. 3, the ratchet 26 is pulled, together with the hook-shaped means 2, into the casing 1 and the carrying hook 16 engages the loading eye 37 and the spring 36 is compressed (FIG. 1). The loading hook is now in a position ready to lift the load. A pull in the hoisting cable (not shown) causes a movement of the casing 1 in relation to the hook-shaped means 2 in such a way that the seats 8 and 9 are brought into contact with the carrying hook 16 (FIG. 4) and thus releases the latter. The seat 8 catches behind the locking abutment 19 on the carrying hook 16 and locks the same in position of use. The lifting of the casing 1 in relation to the hook-shaped means 2 also causes the cogged wheel 30 to leave the ratchet 26. Thus, it prevents the hook-shaped means to be swung unintentionally to the free position shown in FIG. 3.

When the load is deposited and the pull in the carrying hook 16 ceases, the spring 2 presses the hook-shaped means 2 upwards (FIG. 1) whereupon it may be swung outwards (FIG. 3) and the loading eye is released.

The advantage of the two idling positions 34, 35 is to be seen therein that the electric motor 32, in case the operator forgets to switch off the current feeding the same, will not be locked in the end positions of the ratchet and overheated.

The embodiment shown and described in the aforegoing is to be regarded as an example only and the different details of the carrying hook may be modified in many ways within the scope of the invention. The springs 22 and 36 may be arranged otherwise than shown in the drawings to produce the initial tensions between the teeth 28 of the ratchet 26 and the teeth 29 of the cogged wheel 30 at the idling positions 34, 35. Further, other means than the helical springs 22, 36 may be used for the purpose.

What I claim is:

1. In a remote controlled loading hook, a hook-shaped member, a casing on said hook-shaped member journalled with its upper end on a pin in the upper portion of said casing, a driving element adapted to swing said hook-shaped member with its lower end, shaped as a hook, into said casing, said casing freely suspended in a cable, a chain or the like, said hook-shaped member provided with a locking abutment and adapted to bridge an opening in the lower part of said casing, a seat arranged on either side of said opening, said seats arranged to support said hook-shaped member in position of use, said hook-shaped member suspended on said pin in such a way that at the lifting of said casing and the loading of the hook-shaped member the latter can move in vertical direction relative to said casing to a position in which one of said seats catches behind said locking abutment of said hook-shaped member, said hook-shaped member being provided with a ratchet, one end of said ratchet being pivoted to said hook-shaped member so as to cooperate with a cogged wheel on the shaft of an electric motor arranged on said casing.

2. A loading hook in accordance with claim 1, wherein said ratchet has a teethless portion at each end.

3. A loading hook in accordance with claim 1, wherein a guiding bow extends between the ends of the ratchet.

4. A loading hook in accordance with claim 1, wherein said ratchet has a teethless portion at each end, a guiding bow extending between the ends of said ratchet.

5. A loading hook in accordance with claim 1, wherein an arm is arranged on the upper end of said hook-shaped means, a steel spring being clamped between said arm and a fixed pin on said casing said spring adapted to swing said hook-shaped means in a direction into said casing, a guiding bow extending between the ends of said ratchet.

6. A loading hook in accordance with claim 1 wherein a steel spring is inserted between the free end of said ratchet and a wall of said casing situated adjacent said free end.

7. A loading hook in accordance with claim 6 wherein said ratchet has a toothless portion at each end.

8. A loading hook in accordance with claim 1 wherein an arm is arranged on the upper end of said hook-shaped member, a steel spring being clamped between said arm and a fixed pin on said casing, said spring being adapted to swing said hook-shaped member in a direction into said casing, and wherein a guiding bow is provided extending between the ends of said ratchet.

* * * * *